United States Patent [19]

Kuwabara et al.

[11] Patent Number: 4,830,950

[45] **Date of Patent: * May 16, 1989**

[54] SILVER HALIDE PHOTOGRAPHIC MATERIAL

[75] Inventors: Kenichi Kuwabara; Toshiro Takahashi; Keiichi Adachi; Masahiro Okada, all of Kanagawa, Japan

[73] Assignee: Fuji Photo Film Co., Ltd., Kanagawa, Japan

[ * ] Notice: The portion of the term of this patent subsequent to Aug. 9, 2005 has been disclaimed.

[21] Appl. No.: 3,341

[22] Filed: Jan. 14, 1987

[30] Foreign Application Priority Data

Jan. 14, 1986 [JP] Japan ..... 61-5715

[51] Int. Cl.[4] ..... G03C 1/36

[52] U.S. Cl. ..... 430/264; 430/267; 430/522; 430/606; 430/949

[58] Field of Search ..... 430/606, 264, 522, 949, 430/267

[56] References Cited

U.S. PATENT DOCUMENTS

| | | | |
|---|---|---|---|
| 3,984,247 | 10/1976 | Nakamura et al. | 430/522 |
| 4,452,882 | 6/1984 | Akimura et al. | 430/265 |
| 4,681,836 | 7/1987 | Inoue et al. | 430/264 |
| 4,762,769 | 8/1988 | Takahashi et al. | 430/264 |

FOREIGN PATENT DOCUMENTS 584609 2/1947 United Kingdom .

*Primary Examiner*—Paul R. Michl
*Assistant Examiner*—Lee G. Wright
*Attorney, Agent, or Firm*—Sughrue, Mion, Zinn, Macpeak & Seas

[57] ABSTRACT

A silver halide photographic material comprising a support having thereon at least one silver halide emulsion layer; wherein said emulsion layer comprises a silver chloride emulsion or a silver chlorobromide emulsion containing 90 mol % or more silver chloride, which is prepared in the presence of a water-soluble rhodium salt in an amount of $1\times10^{-7}$ to $2\times10^{-5}$ mol per mol of silver halide; and wherein at least one of said emulsion layer and hydrophilic colloidal layers of said material contains a dye compound represented by formula (I)

(I)

wherein:

$R_1$ represents an alkyl group, an alkoxy group, a hydroxy group, an amino group, a substituted amino group, an alkoxycarbonyl group, a carboxy group, a cyano group, a carbamoyl group, a sulfamoyl group, an ureido group, a thioureido group, an acylamido group, a sulfonamido group or a phenyl group, Q represents a sulfoalkyl group, a sulfoalkoxyalkyl group, or an aryl group having at least one sulfo group; $R_2$ represents a hydrogen atom, an alkyl group, an alkoxy group, a hydroxy group or a halogen atom, and $R_3$ and $R_4$, which may be the same or different, each represents an alkyl group or a substituted alkyl group, or when taken together, $R_3$ and $R_4$ may form a 5- to 6-membered ring, provided that $R_1$, $R_3$, and $R_4$ do not represent a methyl group at the same time.

11 Claims, No Drawings

SILVER HALIDE PHOTOGRAPHIC MATERIAL

FIELD OF THE INVENTION

This invention relates to a silver halide photographic material and, more particularly, to a silver halide photographic material which can be handled in a substantially bright environment.

BACKGROUND OF THE INVENTION

In the field of printing duplication, it has been desired to improve the working efficiency in steps of photomechanical process so as to cope with the diversity and complexity of prints.

More specifically in contact works, working efficiency has been improved by conducting photomechanical process in a brighter environment. Therefore, it has been intended to develop silver halide photographic materials for photomechanical use which are capable of being handled in substantially bright environment, and to develop a printer for exposing such photographic materials.

Silver halide photographic materials to be handled in a bright environment means those photographic materials which allow the use of light rays of 400 nm or longer in wavelength, and not containing an ultraviolet ray component, as a safelight.

As processes for preparing light-sensitive materials having a low sensitivity to visible light, there are generally known a process of forming grains by adding a large quantity of a rhodium salt, an iridium salt or a cupric chloride to a silver halide emulsion and a process of adding an organic desensitizing agent such as pinacryptol yellow, phenosafranine, etc.

A particularly preferable process for preparing light-sensitive materials with a super-low sensitivity to visible light is the process of incorporating a water-soluble rhodium salt in a silver halide emulsion. For example, Japanese Patent Application (OPI) Nos. 125734/81 and 149030/81 (the term "OPI" as used herein means an "unexamined published application") disclose a process of incorporating a rhodium salt in an amount as much as $10^{-3}$ to $10^{-5}$ mol per mol of silver.

However, when sufficient handling properties in a bright environment are tried to be obtained by only the addition of rhodium salts, the sensitivity to UV rays is also decreased with the decrease in sensitivity to visible light. In addition, a low contrast photographic characteristic curve results.

In addition, silver salts containing a large quantity of rhodium salt, as described above, have the disadvantage that they tend to be rendered low contrast with respect to the photographic properties thereof, during storage.

In order to avoid these problems, Japanese Patent Application (OPI) No. 193447/84 discloses a process of decreasing the amount of a rhodium salt to be added, by mordanting a dye, having an absorption in the visible light region, to an upper layer of a silver halide emulsion layer. However, this process is disadvantageous in that, in reduction processing, which is often employed in this field for correcting images after development processing of light-sensitive materials for photomechanical process, dyes once decolored in the development processing again acquire their colors.

Conventionally developed silver halide photographic materials which can be handled in a substantially bright environment must be exposed by a printer having an intense light source rich in an ultraviolet ray component, such as a super-high pressurem mercury lamp or a metal halide lamp, due to the super-low sensitivity of the photographic materials.

SUMMARY OF THE INVENTION

An object of the present invention is to provide a high speed light-sensitive material capable of being handled in a substantially bright environment and having an enough sensitivity to be effectively exposed by a halogen lamp as well as a light source rich in a ultraviolet ray component.

This and other objects of the present invention will become apparent from the following description thereof.

The above-described and other objects of the present invention are attained by a silver halide photographic material comprising a support having thereon at least one silver halide emulsion layer; wherein said emulsion layer comprises a silver chloride emulsion or a silver chlorobromide emulsion containing 90 mol % or more silver chloride, which is prepared in the presence of a water-soluble rhodium salt in an amount of $1\times10^{-7}$ to $2\times10^{-5}$ mol per mol of silver halide; and wherein at least one of said emulsion layer and other hydrophilic colloidal layers of said material contains a dye compound represented by formula (I)

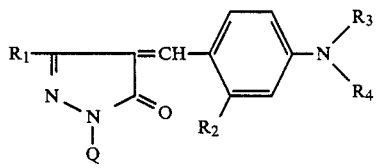

(I)

wherein, $R_1$ represents an alkyl group, an alkoxy group, a hydroxy group, an amino group, a substituted amino group, an alkoxycarbonyl group, a carboxy group, a cyano group, a carbamoyl group, a sulfamoyl group, an ureido group, a thioureido group, an acylamido group, a sulfonamido group or a phenyl group, Q represents a sulfoalkyl group, a sulfoalkoxyalkyl group or an aryl group having at least one sulfo group, $R_2$ represents a hydrogen atom, an alkyl group, an alkoxy group, a hydroxy group, or a halogen atom, and $R_3$ and $R_4$, which may be the same or different, each represents an alkyl group or a substituted alkyl group (the substituents for $R_3$ and $R_4$ being a halogen atom, an alkoxy group, a cyano group, a sulfo group, a carboxy group, an alkoxycarbonyl group, an acyloxy group, an acyl group, an acylamido group, a sulfonamido group, an alkylsulfonyl group, a thioalkyl group, etc.) or, when taken together, $R_3$ and $R_4$ may form a 5- to 6-membered ring, provided that $R_1$, $R_3$, and $R_4$ do not represent a methyl group at the same time.

DETAILED DESCRIPTION OF THE INVENTION

Compounds of formula (I) wherein $R_1$, $R_3$, and $R_4$ represent a methyl group at the same time are not favorable in that they do not show the effect of improving safety properties against a safelight.

The groups represented by $R_1$, $R_3$, and $R_4$ preferably contain up to 15 carbo atoms, more preferably, from 4 to 12 carbon atoms.

The groups represented by $R_2$ preferably contains up to 4 carbon atoms, more preferably, up to 3 carbon atoms.

In formula (I), $R_2$ preferably represents a hydrogen atom, a methyl group, or a methoxy group.

The dye compounds to be used in the present invention represented by formula (I) can be readily prepared by the synthesizing processes described in *The Cyanine Dyes and Related Compounds,* published in 1964, *The Chemistry of Synthetic Dyes,* published by 1971, Japanese Patent Application (OPI) Nos. 3623/76, 10927/76, etc.

The silver halide emulsions used in the present invention are silver chloride emulsions or silver chlorobromide emulsions containing 90 mol % or more silver chloride. Emulsions having a high silver bromide content fail to attain the objects of the present invention, i.e. improving safety properties against a safelight and sensitivity at the same time even when the aforesaid dyes are added thereto.

Examples of the water-soluble rhodium salts used in the present invention include rhodium dichloride, rhodium trichloride, potassium hexachlororhodate (III), ammonium hexachlororhodate (III), etc. Among these, potassium hexachlororhodate (III) and ammonium hexachlororhodate (III) are preferably used in the present invention. The rhodium salts are added before completion of the first ripening in an emulsion preparation process. Particularly preferably, they are added upon formation of the silver halide grains. They are added in amounts of $1\times10^{-7}$ mol to $2\times10^{-5}$ mol per mol of silver halide.

If the amount of the rhodium salt is too small, sufficient safety against a safelight cannot be obtained, whereas, if the amount added is too great, an enough sensitivity to be effectively exposed even by a halogen lamp cannot be obtained.

The silver halide grains used in the present invention have a mean grain size of, preferably, up to 0.5 μm, particularly preferably between 0.1 and 0.4 μm.

The silver halide grains may be in a regular crystal form such as cubic or octahedral form, or may be in a mixed crystal from, and mno-disperse emulsions having a comparatively narrow grain size distribution are preferable. The term "mono-disperse emulsions" as used herein means emulsions wherein 90%, more preferably 95%, in terms of the number of grains of the total number of grains having grain sizes falling within the range of ±40% of the mean grain size.

As the process of reacting a soluble silver salt with a soluble halogen salt for preparing silver halide emulsions used in the present invention, any of a single jet process, a double jet process or a reverse mixing process of forming silver halide grains in the presence of excess silver iron, etc. may be used. However, for attaining the objects of the present invention, the double jet process of adding a soluble silver salt and a soluble halogen salt at the same time to an acidic solution to form grains is particularly preferable. A detailed description thereof is given in *Research Disclosure,* vol. 176, RD NO. 17643, Sections I and II (December, 1978).

The thus prepared silver halide emulsion may or may not be chemically sensitized. From the standpoint of improving handling properties in a substantially bright environment, it is preferable for the silver halide emulsion not to be chemically sensitized. In the case of conducting chemical sensitization, one, or a combination, of ordinary sulfur sensitization, reduction sensitization, and gold sensitization may be conducted. In conducting chemical sensitization, processes described in detail in the aforesaid *Research Disclosure,* Section III, may be employed.

The silver halide emulsion to be used in the present invention may be chemically sensitized.

Further, the silver halide emulsion to be used in the present invention may be optically sensitized for sensitizing in the ultraviolet region, although optical sensitization for sensitizing in the visible region should not be conducted.

In conducting optical sensitization, processes described in detail in the aforesaid *Research Disclosure,* Section IV, may be employed.

The dyes to be added to silver halide emulsion layers or other hydrophilic layers for the purpose of improving handling properties in a substantially bright environment are those which decrease the sensitivity to light of 400 nm or more in wavelength of the intrinsic light-sensitive wavelength region of the aforementioned silver halide emulsion, and compounds of formula (I) having an absorption maximum between 420 and 500 nm in a film are preferable.

Addition of these dyes serves to impart such spectral properties that the sensitivity for light of 360 nm in wavelength is 30 times or greater, preferably 35 times or greater, than the sensitivity for light of 400 nm in wavelength. The ratio of the sensitivity for light of 360 nm in wavelength to that for light of 400 mn in wavelength can be determined by exposing a sample using a spectrally exposing apparatus, developing the sample, and measuring the spectral sensitivity of the thus processed sample.

Specific non-limiting examples of the dyes in accordance with the present invention are illustrated below.

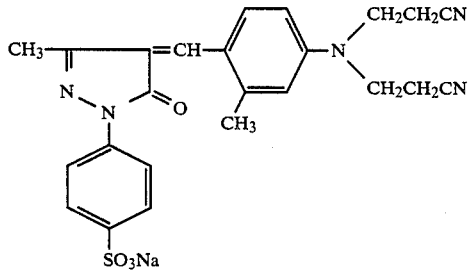

I-1

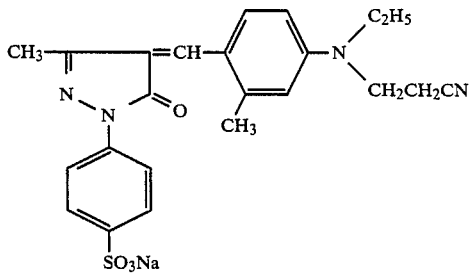

I-2

-continued
I-3
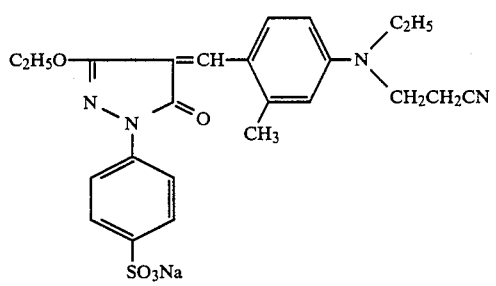
I-4
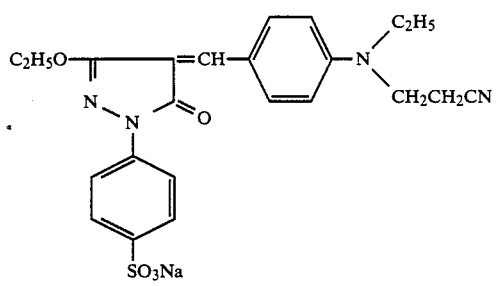
I-5
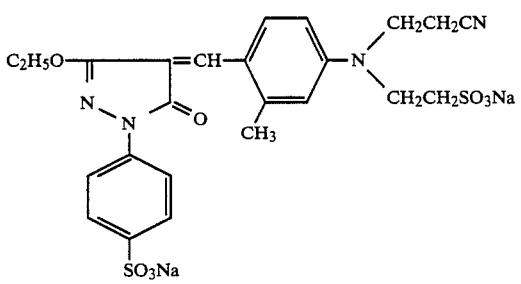
I-6
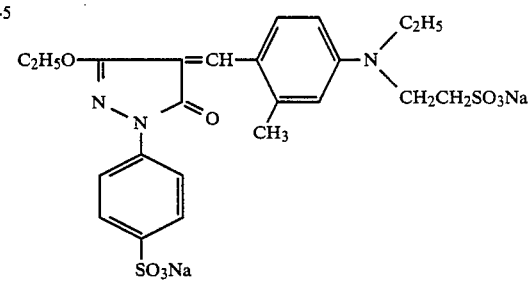
I-7
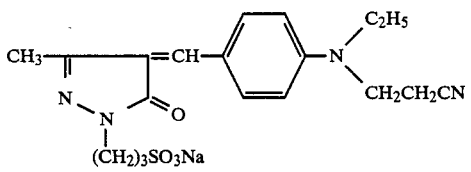
I-8
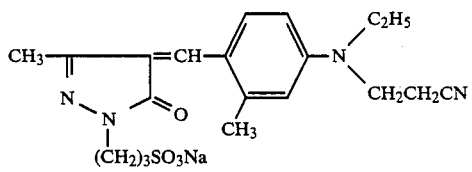
I-9
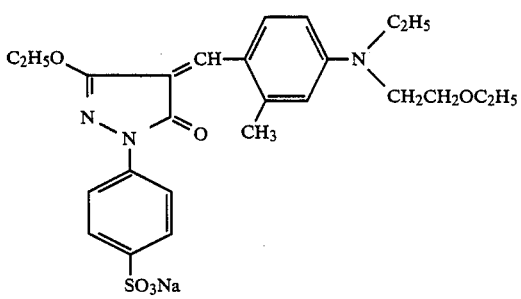
I-10
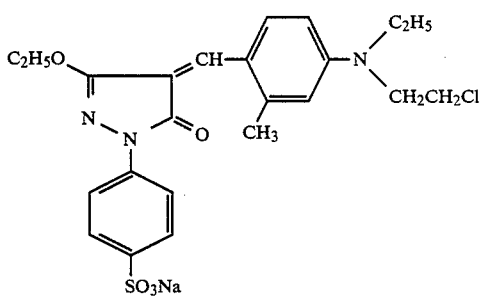
I-11
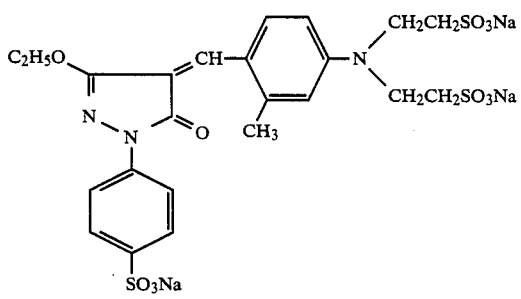
I-12
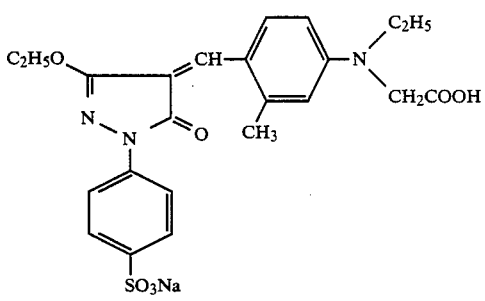
I-13
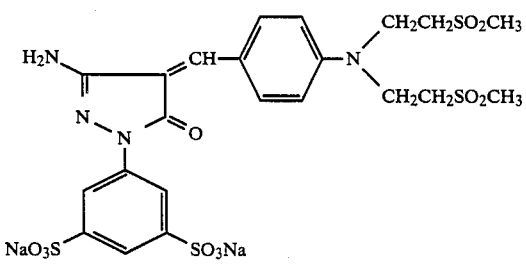
I-14
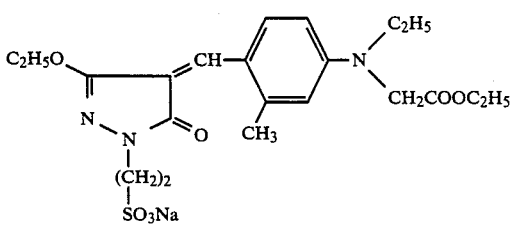

-continued
I-15
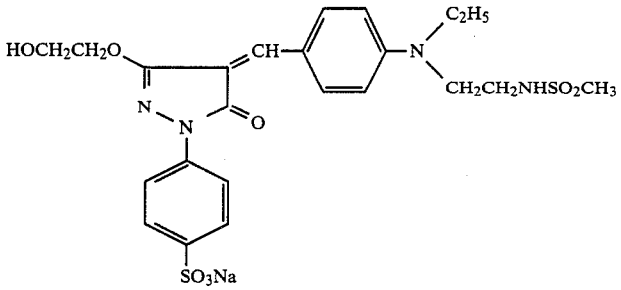
I-16
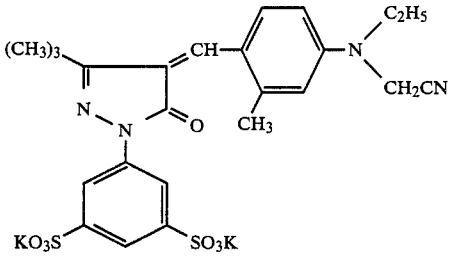
I-17
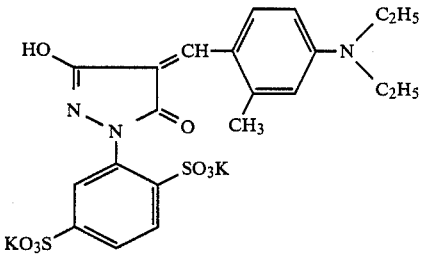
I-18
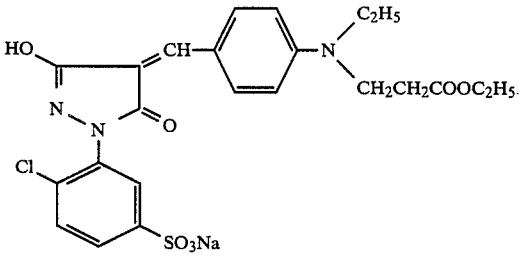
I-19
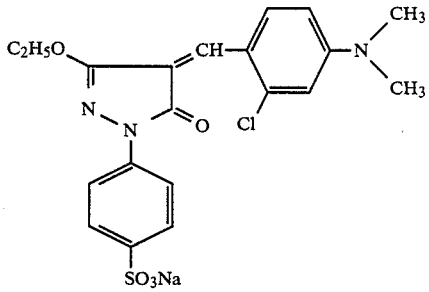
I-20
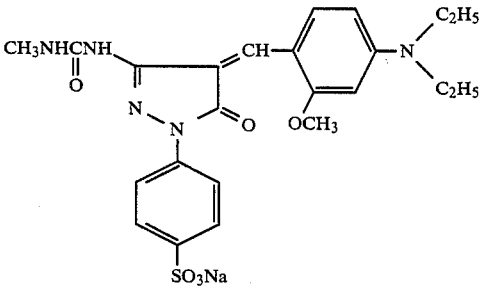
I-21
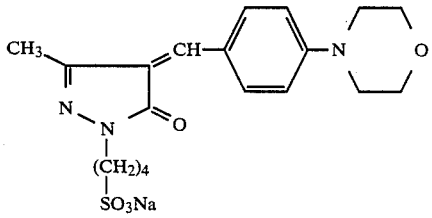
I-22
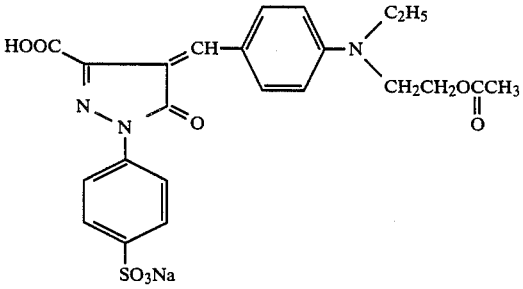
I-23
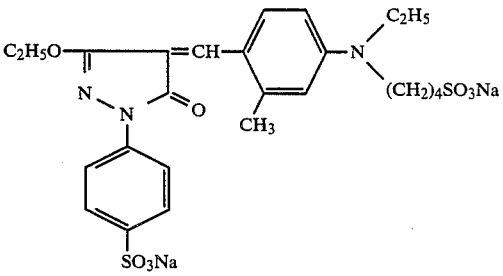

-continued
I-24
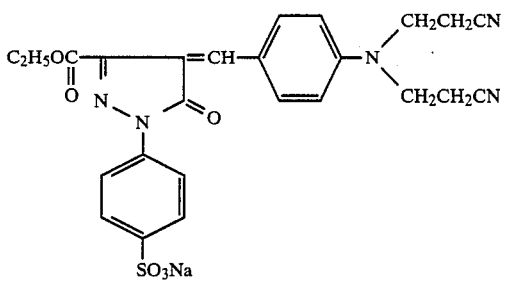
I-25
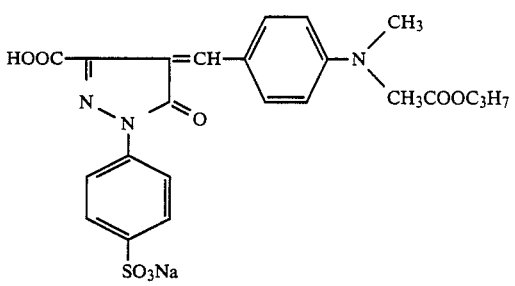
I-26
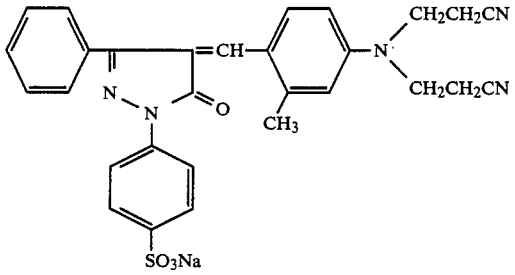
I-27
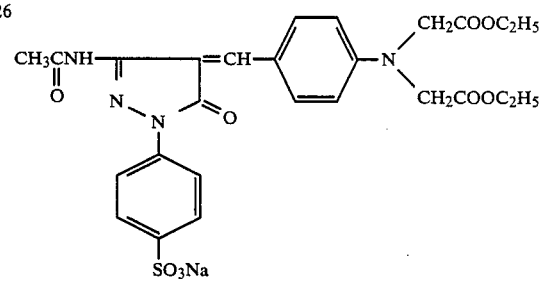
I-28
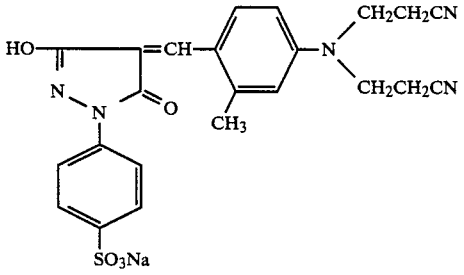
I-29
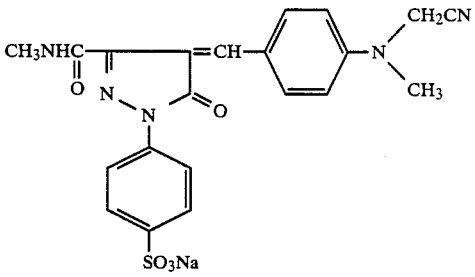
I-30
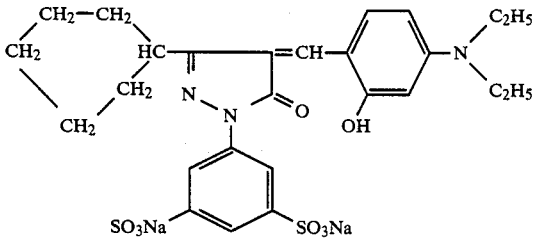
I-31
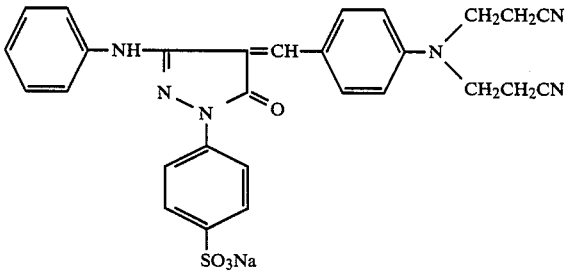

-continued
I-32
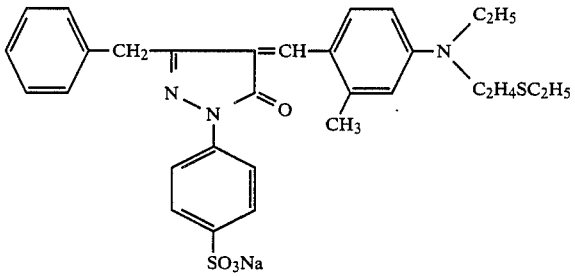
I-33
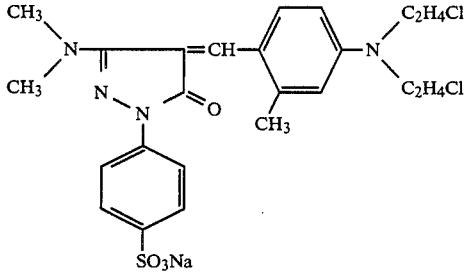
I-34
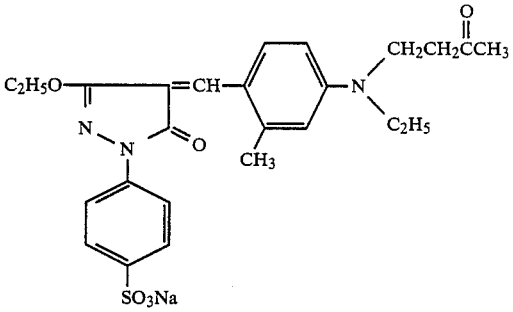
I-35
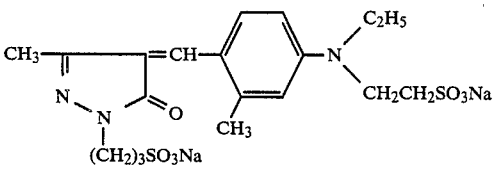
I-36
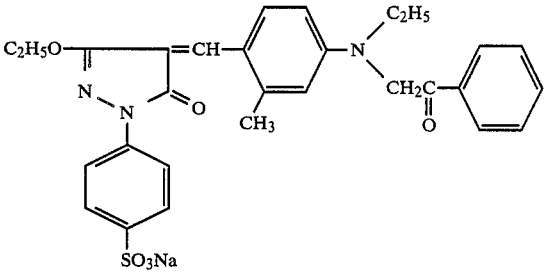
I-37
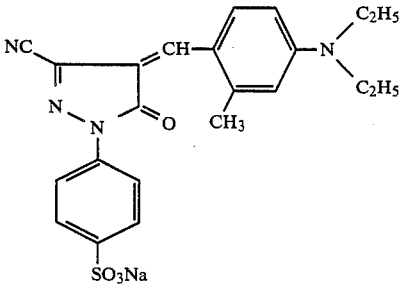
I-38
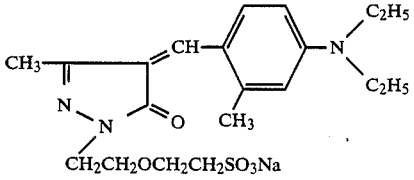
I-39
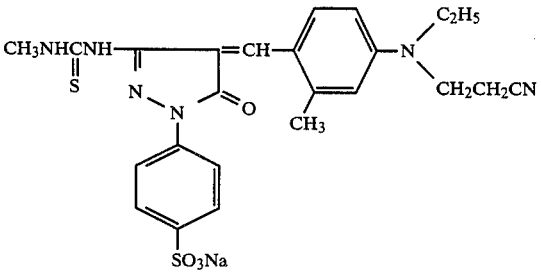

-continued

I-40

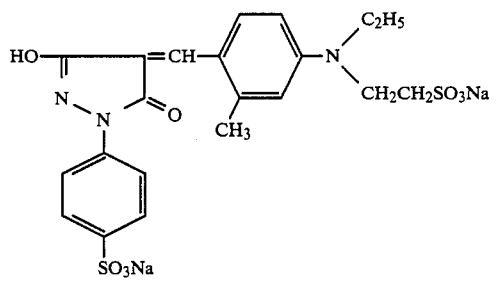

I-41

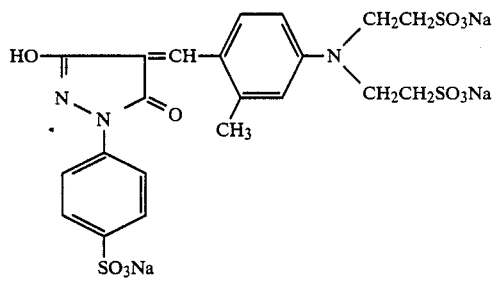

These dyes may be directly added to a silver halide emulsion or a hydrophilic colloid, or may be added thereto as a solution in water or an organic solvent. Further, they may be used together with a mordant.

The mordant which can be used in the present invention includes a secondary or tertiary amino group-containing polymer, a polymer having nitrogen-containing heterocyclic ring moiety, a polymer containing quaternary cationic group thereof, etc. and has a molecular weight of 5,000 to 200,000, in particular, 10,000 to 50,000.

For example, the mordant includes vinylpyridine polymer and vinylpyridinium cationic polymer, as described in U.S. Pat. Nos. 2,548,564, 2,484,430, 3,148,061, 3,756,814, etc.; polymer mordants capable of crosslinking with gelatin, as described in U.S. Pat. Nos. 3,625,694, 3,859,096, 4,128,538, British Patent No. 1,277,453, etc.; aqueous sol mordants as described in U.S. Pat. Nos. 3,958,995, 2,721,852, and 2,798,063, Japanese Patent Application (OPI) Nos. 115228/79, 145529/79 and 126027/79, etc.; water insoluble mordants as described in U.S. Pat. No. 3,898,088; reactive mordants capable of covalent-bonding with dye, as described in U.S. Pat. No. 4,168,976; and mordants as described in U.S. Pat. Nos. 2,675,316, 2,882,156, 3,709,690, 3,788,855, 3,642,482, 3,488,706, 3,557,066, 3,271,147 and 3,271,148, Japanese patent application (OPI) Nos. 71332/75, 30328/78, 155528/77, 125/78 and 1024/78.

The compound represented by formula (I) is added in an amount of preferably 10 mg to 400 mg, more preferably 20 mg to 300 mg, per $m^2$ of a light-sensitive material.

The photographic light-sensitive materials used in the present invention may contain hydrazine derivatives disclosed in U.S. Pat. Nos. 4,166,742, 4,168,977, 4,221,857, 4,224,401, 4,243,739, 4,272,606, 4,311,781, etc. These compounds are added mainly for the purpose of obtaining super-contrasty photographic properties when processing in a developer of 10.5 to 12.3 in pH containing 0.15 mol/liter or more of a sulfite preservative and having a good storage stability.

The hydrazine derivatives are added in an amount of preferably $1\times10^{-6}$ mol to $5\times10^{-2}$ mol, particularly preferably $1\times10^{-5}$ mol to $2\times10^{-2}$ mol, per mol of silver halide.

As the hydrazine derivatives, those of the following formula (II) are preferable:

$$R_5\text{—NHNH—G—}R_6 \qquad \text{(II)}$$

wherein $R_5$ represents an aliphatic group or an aromatic group, $R_6$ represents a hydrogen atom, a substituted or unsubstituted alkyl group, a substituted or unsubstituted aryl group, a substituted or unsubstituted alkoxy group, or a substituted or unsubstituted aryloxy group, and G represents a carbonyl group, a sulfonyl group, a sulfoxy group, a phosphoryl group, or an N-substituted or unsubstituted iminomethylene group.

The aliphatic group represented by $R_5$ in formula (II) preferably contains 1 to 30 carbon atoms and, particularly preferably, a straight chain, branched chain or cyclic alkyl group containing 4 to 20 carbon atoms. The branched-chain alkyl group may be cyclized so as to form a saturated heterocyclic ring containing one or more hetero atoms. The alkyl group may have such substituents as an aryl group, an alkoxy group, a sulfoxy group, a sulfonamido group, a carbonamido group, etc.

The aromatic group represented by $R_5$ in formula (II) is a mono- or bi-cyclic aryl group or an unsaturated heterocyclic group. The unsaturated heterocyclic ring may be condensed with a mon- or bi-cyclic aryl group to form a heteroaryl group. Examples of such include a benzene ring, a naphthalene ring, a pyridine ring, a pyrimidine ring, an imidazole ring, a pyrazole ring, a quinoline ring, an isoquinoline ring, a benzimidazole ring, a thiazole ring, a benzothiazole ring, etc., with those containing a benzene ring or rings being particularly preferable.

Aryl groups are particularly preferable as $R_5$.

The aryl group or the unsaturated heterocyclic group of $R_5$ may be substituted. Examples of substituents, include a straight chain, branched chain, or cyclic alkyl group (containing preferably from 1 to 20 carbon atoms), an aralkyl group (a mono- or bi-cyclic one containing from 1 to 3 carbon atoms in the alkyl moiety thereof), an alkoxy group (containing preferably from 1 to 20 carbon atoms), a substituted amino group (substituted by an alkyl group or groups containing preferably from 1 to 20 carbon atoms), an acylamino group (containing preferably from 2 to 30 carbon atoms), a sulfonamido group (containing preferably from 1 to 30 carbon atoms), an ureido group (containing preferably from 1 to 30 carbon atoms), etc.

The alkyl group represented by $R_6$ in formula (II) is preferably an alkyl group containing from 1 to 4 carbon atoms, which may have such substituents as a halogen atom, a cyano group, a carboxyl group, a sulfo group, an alkoxy group, a phenyl group, etc.

Of the groups represented by $R_6$ in formula (II), the optionally substituted aryl group is preferably a mono- or bi-cyclic aryl group containing, for example, a benzene ring. This aryl group may be substituted by, for example, a halogen atom, an alkyl group, a cyano group, a carboxyl group, a sulfo group, etc.

Of the groups represented by $R_6$ in formula (II), the optionally substituted alkoxy group is preferably an alkoxy group containing from 1 to 8 carbon atoms, which may optionally be substituted by a halogen atom, an aryl group, or the like.

Of the groups represented by $R_6$ in formula (II), the optionally substituted aryloxy group is preferably monocyclic, and substituents therefor include a halogen atom, etc.

Of the groups represented by $R_6$, a hydrogen atom, a methyl group, a methoxy group, an ethoxy group, a substituted or unsubstituted phenyl group are preferable, with a hydrogen atom being particularly preferable, when G represents a carbonyl group.

When G represents a sulfonyl group, $R_6$ preferably represents a methyl group, an ethyl group, a phenyl group or a 4-methylphenyl group, with a methyl group being particularly preferable.

When G represents a phosphoryl group, $R_6$ preferably represents a methoxy group, an ethoxy group, a butoxy group, a phenoxy group or a phenyl group, with a phenoxy group being particularly preferable.

When G represents a sulfoxy group, $R_6$ preferably represents a cyanobenzyl group, a methylthiobenzyl group and, when G represents an N-substituted or unsubstituted iminomethylene group, $R_6$ preferably represents a methyl group, an ethyl group, or a substituted or unsubstituted phenyl group.

$R_5$ or $R_6$ in formula (II) may contain therein a ballast group conventionally used in non-diffusible state photographic additives such as couplers. The ballast group is a group which contain 8 or more carbon atoms and which is comparatively inert in terms of photographic properties. A proper ballast group may be selected from among, for example, an alkyl group, an alkoxy group, a phenyl group, an alkylphenyl group, a phenoxy group, an alkylphenoxy group, etc.

$R_5$ or $R_6$ in formula (II) may contain therein a group capable of enhancing adsorbing properties onto the surface of silver halide grains. Such adsorbing group includes those which are described in U.S. Pat. No. 4,385,108 such as a thiourea group, a heterocyclic thioamido group, a mercaptoheterocyclic group, a triazole group, etc.

As G in formula (II), a carbonyl group is the most preferable.

Specific non-limiting examples of the compounds shown by general formula (II) are illustrated below:

II-1

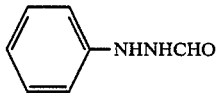

II-2

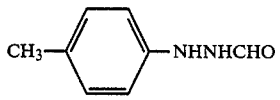

II-3

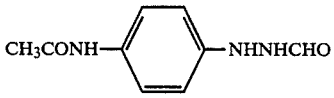

II-4

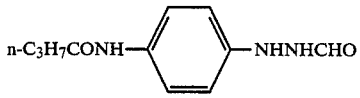

II-5

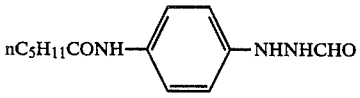

II-6

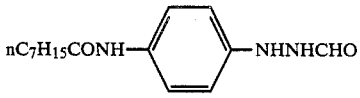

II-7

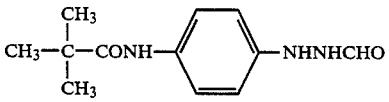

II-8

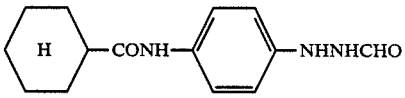

II-9

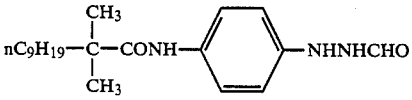

II-10

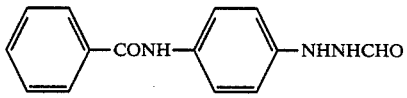

II-11

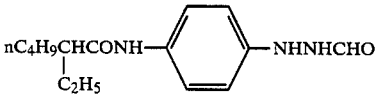

II-12

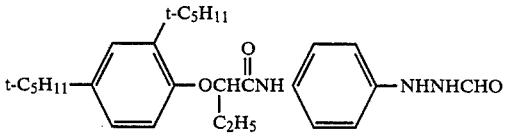

II-13

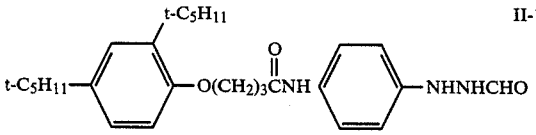

II-14

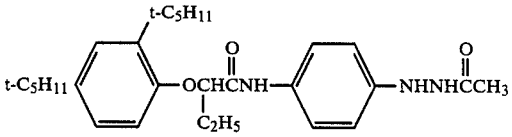

II-15

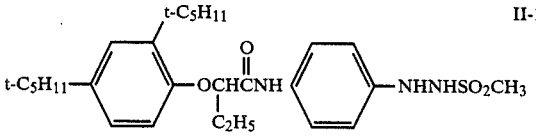

II-16

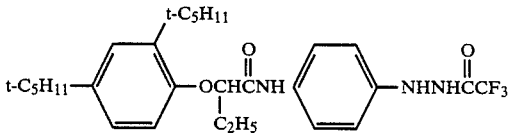

-continued
II-17
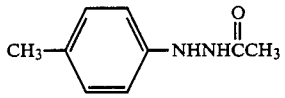
II-18
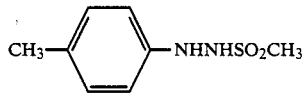
II-19
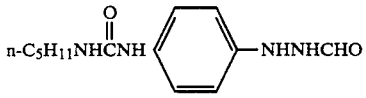
II-20
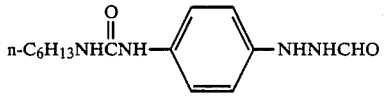
II-21
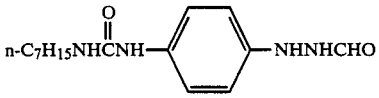
II-22
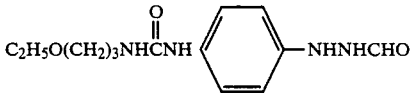
II-23
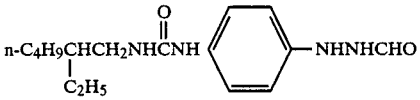
II-24
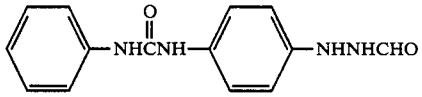
II-25
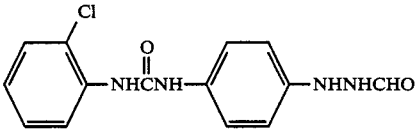
II-26
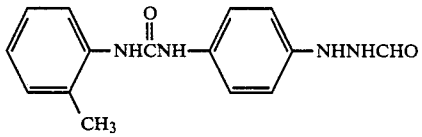
II-27
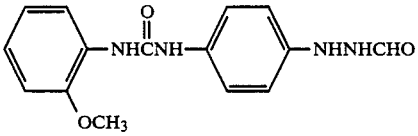
II-28
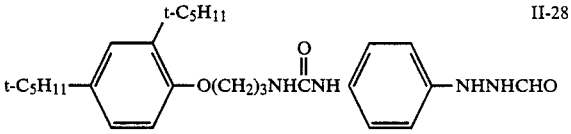
II-29
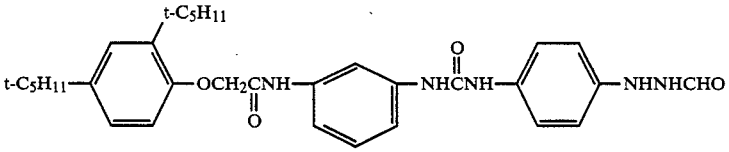
II-30
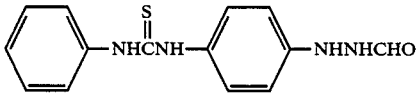
II-31
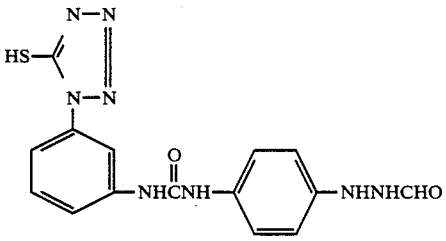
II-32
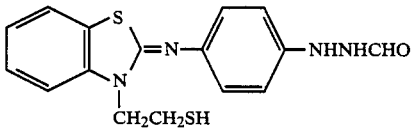
II-33
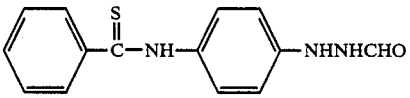
II-34
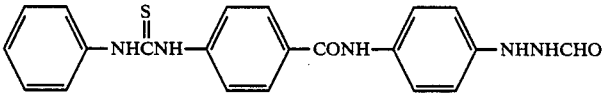
II-35
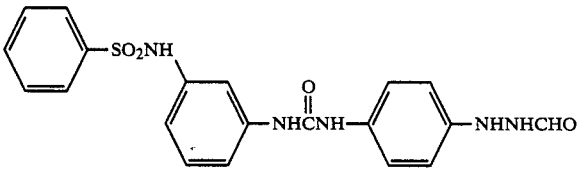

-continued

II-36

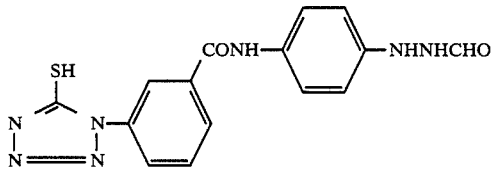

II-37

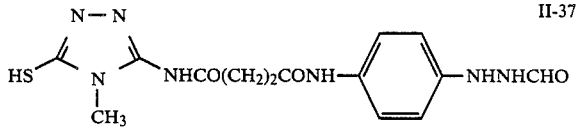

Various compounds for the purpose of preventing the formation of fog or for stabilizing the photographic properties in the steps of producing, or during storage or processing of, the light-sensitive material may be incorporated into the emulsions of the present invention. That is, many compounds such as azoles (e.g., benzothiazolium salts, nitromidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.); mercaptopyrimidines; mercaptotriazines; thioketo compounds such as oxazolinethione; azaindenes (e.g., triazaindenes, tetrazaindenes (particularly 4-hydroxy-substituted (1,3,3a,7)-tetrazaindenes), pentazaindenes, etc.); benzenethiosulfonic acid, benzenesulfinic acid, benzenesulfonic acid amide, etc. known as antifoggants or stabilizers can be added.

The photographic light-sensitive material of the present invention may contain an organic or inorganic hardener in its photographic emulsion layers or other hydrophilic colloidal layers. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids, (e.g., mucochloric acid, mucophenoxychloric acid, etc.), etc. may be used alone or in combinatin.

The light-sensitive material prepared according to the present invention may contain in its photographic emulsion layers or other hydrophilic colloidal layers various surface active agents for various purposes such as improvement of coating properties, antistatic properties, sliding properties, emulsion dispersibility, antiadhesion properties, and photographic properties (for example, development acceleration, realization of contrasty tone, sensitization, etc.).

For example, there can be used nonionic surfaces active agents such as saponins (steroid type), alkylene oxide derivatives (e.g., polyethylene glycol, polyethylene glycol/polypropylene glycol condensate, polyethylene glycol alkyl ethers or polyethylene glycol alkylaryl ethers, polyethylene glycol esters, polyethylene glycol sorbitan esters, polyalkylene glycol alkylamines or amides, silicone polyethylene oxide adducts, etc.), glycidol derivatives (e.g., alkenylsuccinic acid polyglycerides, alkylphenol polyglycerides, etc.), polyhydric alcohol fatty acid esters, sugar alkyl esters, etc.; anionic surface active agents having an acidic group such as a carboxy group, a sulfo group, a phospho group, a sulfuric ester group, or a phosphoric ester group (e.g., alkylcarboxylates, alkyl-sulfonates, alkylbenzenesulfonates alkylnaphthalenesulfonates, alkylsulfates, alkylphosphates, N-acyl-N-alkyltaurines, sulfosuccinates, sulfoalkylpolyoxyethylene alkylphenyl ethers, polyoxyethylene alkylphosphates, etc.; amphoteric surface active agents such as amino acids, aminoalkylsulfonic acids, aminoalkylsulfuric acid or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium or imidazolium, phosphonium or sulfonium salts containing alphatic or heterocyclic ring, etc.

In addition, fluorine-containing surface active agents described in U.S. Pat. Nos. 3,589,906, 3,666,478, 3,754,924, Japanese Patent Application (OPI) No. 59025/75, etc. may also be used.

Photographic light-sensitive materials used in the present invention may contain in the photographic emulsion layer or other hydrophilic colloidal layers thereof a dispersion of a water-insoluble or sparingly water-soluble synthetic polymer for the purpose of improving dimensional stability or the like. For example, polymers containing as monomer components alkyl (meth)acrylates, alkoxyalkyl (meth)acrylates, glycidyl (meth)acrylate, (meth)acrylamide, vinyl esters (e.g., vinyl acetate), acrylonitrile, olefin, styrene, etc. alone or in combination, or polymers containing as monomer components combinations of the above-described monomers and acrylic acid, methacrylic acid, $\alpha,\beta$-unsaturated dicarboxylic acid, hydroxyalkyl (meth)acrylate, sulfoalkyl (meth)acrylate, styrenesulfonic acid, etc. may be used.

The silver halide emulsion layers and the hydrophilic colloidal layers in accordance with the present invention may contain photographic additives such as a matting agent, a pH-adjusting agent, a plasticizers, a thickener, a fluorescent brightening agent, a UV ray absorbent, etc. These additives are described in detail in *Research Disclosure*, vol. 176, RD No. 17643, pp. 23–28 (December, 1978).

Examples of supports used for the silver halide photographic materials of the present invention include transparent or opaque films of synthetic resins such as polyethylene terephthalate, polycarbonate, polystyrene, polypropylene, etc., polyethylene resin-coated paper supports, etc.

In the processing the silver halide photographic materials of the present invention, the developers may be one which is used for processing ordinary photographic materials. However, a black-and-white development processing solution used in the field of photomechanical process is particularly preferable.

Examples of the developing agents used in the developer include dihydroxybenzenes (e.g., hydroquinone, chlorohydroquinone, methylhydroquinone, etc.), 3-pyrazolidones (e.g., 1-phenyl-3-pyrazolidone, 1-phenyl-4-methyl-3-pyrazolidone, 1-phenyl-4,4-dimethyl-3-pyrazolidone, etc.), aminophenols (e.g., o-aminophenol, p-aminophenol, N-methyl-p-aminophenol, etc.), etc. These developing agents may be used alone or in combination of two or more.

Particularly preferably, hydroquinone alone, a combination of hydroquinone and a 1-phenyl-3-pyrazolidone (so-called PQ type), or a combination of hydroquinone and a p-aminophenol (so-called MQ type) is used.

In the processing light-sensitive materials containing the aforementioned hydrazine derivatives, the use of a PQ-type or MQ-type developer is preferable.

The developing agent is used preferably in an amount of 0.05 mol/liter to 0.8 mol/liter. In the case of using a combination of dihydroxybenzene and 1-phenyl-3-pyrazolidone or p-aminophenol, it is preferable to use the former in an amount of 0.05 mol/liter to 0.5 mol/liter and the latter in an amount of up to 0.06 mol/liter.

To the developer is added, as a preservative, a compound capable of releasing free sulfite ion such as sodium sulfite, potassium sulfite, potassium metabisulfite, sodium bisulfite, formaldehyde-sodium bisulfite, etc.

In order to adjust the pH of the developer to be used in the present invention, such compounds as sodium hydroxide, potassium hydroxide, sodium carbonate, potassium carbonate, sodium tertiary phosphate, potassium tertiary phosphate, etc. are used as pH-adjusting agents or buffering agents.

The pH of the developer is usually in the range of from 9.0 to 12.3, preferably 9.5 to 12.0.

In addition, the developer used in the present invention may contain a development restrainer or antifogging agent such as potassium bromide, potassium iodide, or an organic antifogging agent (particularly preferably, nitroimidazole, nitrobenzimidazole, benzotriazole, mercaptotetrazole, benzothiazole, etc.), a dissolving aid such as polyethylene glycol, a surfactant, a chelating agent, a hard water softener, a development-accelerating agent, a defoaming agent, a toning agent, a hardener, a silver stain-preventing agent (for example, 2-mercaptobenzimidazolesulfonic acids), etc. Specific examples of these additives are described in *Research Disclosure,* No. 176, Section VI, RD No. 17643, etc.

The developing temperature is usually selected from between 18° C. and 50° C., preferably between 20° C. and 40° C. The developing time is preferably 5 seconds to 200 seconds.

As a fixing solution, those with a commonly used formulation may be used. As a fixing agent, organic sulfur compounds known to have a fixing effect may be used as well as fthiosulfates and thiocyanates. The fixing solution may further contain aluminum hydroxide, etc. as a hardener.

Preferable results for attaining a constant finished quality can be obtained by processing the photographic light-sensitive material of the present invention using an automatic developing machine which can continuouslsy conduct the steps of development, fixing, and drying.

In the case of using an automatic developing machine, a rapid development processing for 10 seconds to 120 seconds is preferably employed.

The present invention is now illustrated in greater detail by reference to the following examples which, however, are not to be construed as limiting the present invention in any way. Unless otherwise indicated, all parts, percents and ratios are by weight.

EXAMPLE 1

(Preparation of Emulsion A)

A silver nitrate aqueous solution (350 ml, $AgNO_3$: 165 g) was mixed with 350 ml of a sodium chloride aqueous solution (NaCl: 59.5 g) containing $5\times10^{-6}$ mol of ammonium hexachlororhodate (III) per mol of silver according to a double-jet process in a 40° C. gelatin aqueous solution with the pH controlled to be 2.3, to thereby prepare a mono-disperse silver chloride emulsion having a mean grain size of 0.2 μm.

After formation of the grains, soluble salts were removed by a flocculation process well known in the art, and $3\times10^{-3}$ mol of 4-hydroxy-6-methyl-1,3,3a,7-tetrazaindene and $5\times10^{-4}$ mol of 1-phenyl-5-mercaptotetrazole were added thereto as stabilizers. The resulting emulsion (Emulsion A) contained 55 g of gelatin and 105 g of silver per kg of the emulsion.

(Preparation of Emulsion B)

A mono-disperse silver chlorobromide emulsion (Emulsion B) (content of silver bromide: 2 mol %) having a mean grain size of 0.2 μm was prepared in the same manner as Emulsion A above except that 350 ml of an aqueous solution of sodium chloride and potassium bromide (NaCl: 58.4 g, KBr: 2.3 g, $(NH_4)_3RhCl_6$: $1.8\times10^{-3}$ g) was employed in place of the sodium chloride aqueous solution.

(Preparation of Emulsion C)

A mono-disperse silver chlorobromide emulsion (Emulsion C) (content of silver bromide: 15 mol %) having a mean grain size of 0.2 μm was prepared in the same manner as Emulsion B above except for changing the amounts of sodium chloride and potassium bromide.

(Preparation of Emulsion D)

A mono-disperse silver chloride emulsion (Emulsion D) having a mean grain size of 0.2 μm was prepared in the same manner as Emulsion A above except for changing the amount of ammonium hexachlororhodate (III) from $5\times10^{-6}$ mol to $5\times10^{-5}$ mol.

To 100 g of each of Emulsions A to D was added 0.4 g of a dye compound shown by I-3 and, further, 0.4 g of 2,4-dichloro-6-hydroxy-1,3,5-triazine sodium salt per 100 g of the emulsion was added thereto as a hardener. Each of these emulsions was coated on a polyethylene terephthalate transparent support in a silver amount of 3.5 g/m$^2$, followed by coating thereon a gelatin layer (coated amount of gelatin: 1.2 g/m$^2$) as a protective layer to prepare light-sensitive materials Sample Nos. 1 to 4.

To 100 g of each of Emulsions A to D was added 0.4 g of a dye compound represented by I-6 in place of the dye compound represented by I-3 and, further, 0.4 g of 2,4-dichloro-6-hydroxy-1,3,5-triazine sodium salt per 100 g of the emulsion was added thereto as a hardener. Each of these emulsions was coated on a polyethylene terephthalate transparent support in a silver amount of 3.5 g/m$^2$, followed by coating thereon a gelatin layer as a protective layer to prepare light-sensitive materials Sample Nos. 5 to 8.

In addition, light-sensitive materials Sample Nos. 9 to 12 were prepared in the same manner as light-sensitive materials Sample Nos. 1 to 4 except using comparative dye Compound (a) below in place of the dye compound represented by I-3. Comparative dye Compound (a):

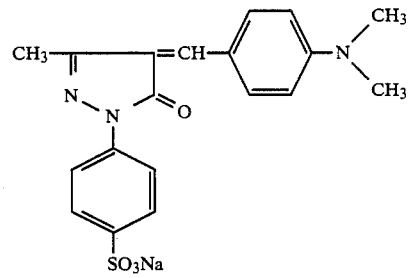

Each of the light-sensitive materials Sample Nos. 1 to 12 was exposed by means of a printer (model P-617DQ; made by Dainippon Screen Mfg. Co., Ltd.) (containing as a light source 100-V, 1-kw quartz halogen lamp) through an optical wedge, developed for 20 seconds at 38° C. using developer (I) of the following formulation, then fixed at 38° C. for 20 min., washed with water at 38° C. for 20 min., and dried at ordinary temperature in a conventional manner.

The density of each of the thus processed samples was measured to determine the relative value of the exposure amount giving a density of 4.0. Formulation of developer (I):

| | |
|---|---|
| Hydroquinone | 35.0 g |
| N—methyl-p-aminophenol ½ sulfate | 0.8 g |
| Sodium hydroxide | 9.0 g |
| Potassium tertiary phosphate | 74.0 g |
| Potassium sulfite | 90.0 g |
| Disodium ethylenediamine-tetraacetate | 1.0 g |
| Sodium bromide | 3.0 g |
| 5-Methylbenzotriazole | 0.5 g |
| 3-Diethylamino-1-propanol | 15.0 g |
| Water to make | 1 liter |
| (pH: adjusted to 11.60) | |

Each of light-sensitive materials Sample Nos. 1 to 12 was left for 0 to 60 minutes under the brightness of 200 lux light emitted from a fading-preventing fluorescent lamp (FLR40SW-DL-X NU/M) made to Toshiba Corporation as a safelight, then developed using the aforementioned developer (I) for 20 seconds at 38° C., fixed, washed with water, and dried as described above.

The density of each of the thus-processed samples was measured to determine the time within which the fog density did not increase more than 0.02. The thus determined time was taken as safelight irradiation time limit.

The results obtained are shown in Table 1 below.

TABLE 1

| Sample No. | Sample Content: Halide Composition | Sample Content: Rhodium Content (mol/mol-Ag) | Sample Content: Dye Compound | Photographic Properties: Relative Sensitivity*1 | Photographic Properties: Safelight Irradiation Time Limit*2 (min.) | Photographic Properties: $S_{360}/S_{400}$*3 | Remarks |
|---|---|---|---|---|---|---|---|
| 1 | AgCl | $5 \times 10^{-6}$ | I-3 | 100 | 25 | 40 | Present invention |
| 2 | AgClBr(Br: 2 mol %) | " | " | 132 | 20 | 35 | Present invention |
| 3 | AgClBr(Br: 15 mol %) | " | " | 200 | 6 | 28 | comparative ex. |
| 4 | AgCl | $5 \times 10^{-5}$ | " | 12.6 | 60 or more | 40 | comparative ex. |
| 5 | AgCl | $5 \times 10^{-6}$ | I-6 | 126 | 30 | 50 | present invention |
| 6 | AgClBr(Br: 2 mol %) | " | " | 162 | 25 | 45 | present invention |
| 7 | AgClBr(Br: 15 mol %) | " | " | 240 | 8 | 35 | Comparative ex. |
| 8 | AgCl | $5 \times 10^{-5}$ | " | 15.8 | 60 or more | 50 | Comparative ex. |
| 9 | AgCl | $5 \times 10^{-6}$ | (a) | 89 | 10 | 22 | Comparative ex. |
| 10 | AgClBr(Br: 2 mol %) | " | " | 112 | 8 | 20 | Comparative ex. |
| 11 | AgClBr(Br: 15 mol %) | " | " | 178 | 2 | 16 | Comparative ex. |
| 12 | AgCl | $5 \times 10^{-5}$ | " | 11.8 | 25 | 18 | Comparative ex. |

*1Sensitivity: presented as a relative value of a reciprocal of the exposure amount giving a density of 4.0, where Sample No. 1 is 100.
*2Safelight irradiation time limit: Irradiation time limit within which fog does not increase more than +0.02 when samples were left under a 200-lux light of a fading preventing fluorescent lamp (FLR40SW-DL-X-NU/M) made by Toshiba Corporation.
*3$S_{360}/S_{400}$: Ratio of sensitivity for light of 360 nm in wavelength to that for light of 400 nm. This value was determined from the spectral sensitivity obtained by exposing the samples using a spectrally exposing apparatus and developing them.

Light-sensitve materials which can be practically printed by exposure using a P-617DQ-model printer must have a reltive sensitivity of 80 or more.

Light-sensitive materials Sample Nos. 1, 2, 5, and 6 in accordance with the present invention have a relative sensitivity of 100 or more and have a safe time or not shorter than 20 minutes when handled under the aforementioned safelight. Thus, it is seen that these samples of the present invention have particularly excellent properties with respect to sensitivity and safelight safety in comparison with the comparative samples.

EXAMPLE 2

Light-sensitive materials Sample Nos. 13 to 18 were prepared by adding a compound represented by I-6 or a compound represented by II-28, as shown in Table 2, to Emulsion A of Example 1, and 0.4 g of 2,4-dichloro-6-hydroxy-1,3,5-triazine sodium salt per 100 g of the emulsion as a hardener, coating each of the resulting silver halide emulsions on a polyethylene terephthalate transparent support in a silver amount of 3.5 g/m$^2$, and coating thereon a gelatin layer (coated amount of gelatin: 1.2 g/m$^2$) as a protective layer.

Each of light-sensitive materials Sample Nos. 13 to 18 was exposed in the same manner as in Example 1 using a printer of model P617DQ (made by Dainippon Screen Mfg. Co., Ltd.; light source: 100-V, 1-kw quartz halogen lamp), developed at 38° C. for 20 seconds in a developer of the aforementioned formulation, then fixed, washed with water, and dried as described above.

The density of each of the thus-developed samples was measured to determine the relative value of the exposure amount giving a density of 4.0.

Each of the light-sensitive materials Sample Nos. 13 to 18 was left for 0 to 60 minutes under a brightness of 200-lux light emitted from a fading preventing fluorescent lamp (FLR40SW-DL-X NU/M) made by Toshiba Corporation as a safelight, then developed using the aforementioned developer (I) for 20 seconds at 38° C., fixed, washed with water, and dried as described above.

The density of each of the thus processed samples was measured to determine the time at which the fog density started to increase. (The time at which the fog density increased by 0.02 was presented as a limit.)

The results thus obtained are shown in Table 2.

TABLE 2

| Sample No. | Sample Content: Amount of Dye Compound I-6 added | Sample Content: Compound II-28 | Photographic Properties: Relative Sensitivity*1 | Photographic Properties: Safelight Irradiation Time Limit*2 | Photographic Properties: $S_{360}/S_{400}$*3 | Remarks |
|---|---|---|---|---|---|---|
| 13 | — | — | 178 | 8 min. | 18 | comparative ex. |
| 14 | — | 70 mg/m$^2$ | 562 | 7 min. | 20 | comparative ex. |
| 15 | 130 mg/m$^2$ | — | 126 | 30 min. | 50 | present invention |
| 16 | " | 70 mg/m$^2$ | 417 | 25 min. | 45 | present invention |
| 17 | 180 mg/m$^2$ | — | 105 | 40 min. | 56 | present invention |
| 18 | " | 70 mg/m$^2$ | 347 | 35 min. | 56 | present invention |
| 1 | (I-3) 130 mg/m$^2$ | — | 100 | 25 min. | 40 | present invention |

*1Sensitivity: presented as a relative value of the reciprocal of the exposure amount giving a density of 4.0, where Sample No. 1 is 100.
*2Safelight irradiation time limit: Irradiation time limit within which fog does not increase more than +0.02 when samples were left under a 200-lux light of fading-preventing fluorescent lamp (FLR40SW-DL-X NU/M) made by Toshiba Corporation.
*3$S_{360}/S_{400}$: Ratio of sensitivity for light of 360 nm in wavelength to that for light of 400 nm. This value was determined from the spectral sensitivity obtained by exposing the sample using a spectrally exposing apparatus and developing them.

From the results shown in Table 2, it is seen that light-sensitive materials Sample Nos. 15 to 18 have an enough sensitivity to be practically exposed to print using a 1-kw quartz halogen lamp, and showed excellent safelight safety under a UV ray-cut fluorescent lamp.

Particularly, Sample Nos. 16 and 18 using the dye compound and the hydrazine derivative in combination have a high sensitivity, thus showing more preferable photographic properties.

While the present invention has been described in detail and with reference to specific embodiments thereof, it is apparent to one skilled in the art that various changes and modifications can be made therein without departing from the spirit and the scope of the present invention.

What is claimed is:

1. A silver halide photographic material comprising a support having thereon at least one silver halide emulsion layer; wherein said emulsion layer comprises a silver chloride emulsion or a silver chlorobromide emulsion containing 90 mol% or more silver chloride, which is prepared in the presence of a water-soluble rhodium salt in an amount of $1\times10^{-7}$ to $2\times10^{-5}$ mol per mol of silver halide; and wherein at least one of said emulsion layer and other hydrophilic colloidal layers of said material contains a dye compound represented by formula (I)

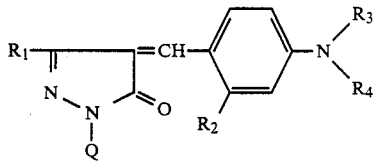

(I)

wherein:

$R_1$ represents an alkyl group, an alkoxy group, a hydroxy group, an amino group, a substituted amino group, an alkoxycarbonyl group, a carboxy group, a cyano group, a carbamoyl group, a sulfamoyl group, an ureido group, a thioureido group, an acylamido group, a sulfonamido group or a phenyl group;

Q represents a sulfoalkyl group, a sulfoalkoyalkyl group, or an aryl group having at least one sulfo group;

$R_2$ represents a hydrogen atom, an alkyl group, an alkoxy group, a hydroxy group or a halogen atom; and $R_3$ and $R_4$, which may be the same or different, each represents an alkyl group or a substituted alkyl group, or, when taken together, $R_3$ and $R_4$ may form a 5- to 6-membered ring, provided that $R_1$ $R_3$, and $R_4$ do not represent a methyl group at the same time, wherein the dye represented by formula (I) is incorporated in an amount such that the sensitivity of said material for light of 360 nm in wavelength is 30 times or greater than that for light of 400 nm in wavelength.

2. The silver halide photographic material as claimed in claim 1, wherein said water-soluble rhodium salt is selected from the group consisting of rhodium dichloride, rhodium trichloride, potassium hexachlororhodate (III) and ammonium hexachlororhodate (III).

3. The silver halide photographic material as claimed in claim 1, wherein the grains of said silver halide have a mean grain size of up to 0.5 μm.

4. The silver halide photographic material as claimed in claim 3, wherein the grains of said silver halide have a mean grain size of up to 0.1 to 0.4 μm.

5. The silver halide photographic material as claimed in claim 1, wherein the dye represented by formula (I) is incorporated in an amount such that the sensitivity of said material for light of 360 nm in wavelength is 35 times or greater than that for light of 400 nm in wavelength.

6. The silver halide photogaphic material as claimed in claim 1, wherein the amount of said compound represented by formula (I) is 10 mg to 400 mg per $m^2$ of said light-sensitive material.

7. The silver halide photographic material as claimed in claim 6, wherein the amount of said compound represented by formula (I) is 20 mg to 300 mg per $m^2$ of said light-sensitive material.

8. The silver halide photographic material as claimed in claim 1, wherein said silver halide photographic material additionally contains a hydrazine derivative represented by formula (II)

$$R_5—NHNH—G—R_6 \quad (II)$$

wherein $R_5$ represents an aliphatic group or an aromatic group, $R_6$ represents a hydrogen atom, a substituted or unsubstituted alkyl group, a substituted or unsubstituted aryl group, a substituted or unsubstituted alkoxy group or a substituted or unsubstituted aryloxy group, and G represents a carbonyl group, a sulfonyl group, a sulfoxy group, a phosphoryl group or an N-substituted or unsubstituted iminomethylene group.

9. The silver halide photographic material as claimed in claim 8, wherein said hydrazine compound is employed in an amount of from $1\times10^{-6}$ mol to $5\times10^{-2}$ mol/mol of silver halide.

10. The silver halide photographic material as claimed in claim 9, wherein said hydrazine compound is employed in an amount of from $1\times10^{-5}$ mol to $2\times10^{-2}$ mol/mol of silver halide.

11. The silver halide photographic material as claimed in claim 1, wherein said water-soluble rhodium salt is added before completion of the first ripening in the emulsion preparation process.

* * * * *